US005372454A

United States Patent [19]

Lawrence

[11] Patent Number: 5,372,454

[45] Date of Patent: Dec. 13, 1994

[54] SYSTEM FOR VAPOR RECOVERY WITHOUT FORMATION OF FLUID BLOCKAGES AND A PIPE THEREFOR

[75] Inventor: James L. Lawrence, Exton, Pa.

[73] Assignee: Total Containment, Inc., Oaks, Pa.

[21] Appl. No.: 945,318

[22] Filed: Sep. 10, 1992

[51] Int. Cl.[5] ..... B65B 31/06

[52] U.S. Cl. ..... 405/53; 405/154; 137/588; 138/105; 138/121; 141/59

[58] Field of Search ..... 405/36, 49, 51, 53, 405/154, 52; 137/236.1, 588; 138/105, 121, 173, 177, DIG. 11; 141/44, 45, 46, 59, 302

[56] References Cited

U.S. PATENT DOCUMENTS

| | | | |
|---|---|---|---|
| 987,398 | 3/1911 | Potter . | |
| 2,406,838 | 9/1946 | Kepler | 138/173 X |
| 2,908,299 | 10/1959 | Gosselin . | |
| 3,681,925 | 8/1972 | Schmunk et al. . | |
| 3,905,405 | 9/1975 | Fowler et al. | 141/46 |
| 3,907,002 | 9/1975 | Gülich | 138/115 |
| 3,926,230 | 12/1975 | Stary et al. | 141/45 |
| 3,927,464 | 12/1975 | Wallsten . | |
| 3,961,486 | 6/1976 | Granholm et al. | 138/DIG. 11 X |
| 4,020,639 | 5/1977 | Nagare et al. | 138/105 X |
| 4,086,937 | 5/1978 | Hechler . | |
| 4,101,607 | 7/1978 | Bart . | |
| 4,253,503 | 3/1981 | Gunn | 141/59 |
| 4,310,033 | 1/1982 | Deters | 141/44 |
| 4,605,338 | 8/1986 | Peterson | 138/173 X |
| 4,787,772 | 11/1988 | Wagner | 405/53 |
| 4,904,113 | 2/1990 | Goddard et al. | 405/49 X |
| 4,968,179 | 11/1990 | Frahm | 405/53 |
| 4,971,477 | 11/1990 | Webb et al. | 405/154 |
| 4,995,759 | 2/1991 | Plowman et al. | 405/43 |
| 5,106,235 | 4/1992 | King | 405/154 |
| 5,145,545 | 9/1992 | Winter et al. | 156/244.13 |
| 5,213,142 | 5/1993 | Koch et al. | 141/59 |

*Primary Examiner*—Randolph A. Reese
*Assistant Examiner*—John Ricci
*Attorney, Agent, or Firm*—Merek & Voorhees

[57] ABSTRACT

System for vapor recovery without formation of fluid blockages includes a vapor source, a fluid collection tank for collecting vapor, and a vapor recovery pipe extending between and fluidly collecting the vapor source and the fluid collection tank. The vapor recovery pipe slopes vertically downwardly from the vapor source to the fluid collection tank so that vapor flows into the fluid collection tank. The vapor recovery pipe has an elongated cross section, and a direction of elongation of the cross section extends substantially vertically. The vapor recovery pipe is engineered and is installed in such a manner that the vapor recovery pipe resists bending in a substantially vertical plane and allows bending in a substantially horizontal plane. Accordingly, the vapor recovery pipe according to the invention can be installed without surveying equipment, overcomes surface irregularities, and by resisting bending in a vertical direction ensures that no fluid blockages are formed along the length thereof. The bending of the vapor recovery pipe in the horizontal direction allows for the pipe to be installed around curves without the need for curved joints or couplings.

7 Claims, 1 Drawing Sheet

SYSTEM FOR VAPOR RECOVERY WITHOUT FORMATION OF FLUID BLOCKAGES AND A PIPE THEREFOR

FIELD OF THE INVENTION

This invention relates to a system for recovering vapor without the formation of fluid blockages, a pipe for use in the vapor recovery system, and a method of installing such a system.

BACKGROUND OF THE INVENTION

It has long been recognized that unburned hydrocarbons, such as those released into the atmosphere during the conventional storage and distribution of gasoline, are harmful to the environment.

Attempts have been made to contain, collect, and recover vapors escaping from fluid distribution systems. Given that gasoline, for example, is often stored in tanks underground and is distributed from underground pipes, known vapor recovery systems have experienced the drawbacks of recovered vapors liquefying and causing blockages in the known vapor recovery systems. Liquefaction of recovered vapor typically occurs because the ambient temperature of the part of the vapor recovery system placed underground is often lower than the ambient temperature of the above ground parts of the vapor recovery system, especially in the summertime. Such liquid blockages not only prevent known vapor recovery systems from operating correctly, but can lead to underground fluid leaks which harm the environment.

Conventional systems are also difficult and expensive to install owing to the precise layout of the vapor recovery system required. Changes in elevation of vapor recovery systems can lead to undesirable formation of liquid blockages in the system.

Increasingly, local and federal regulations are requiring vapor recovery systems which are able to recover a greater percentage of vapors to prevent their escaping into the environment.

Accordingly, there is a need for vapor recovery system which overcomes these and other drawbacks.

FEATURES AND SUMMARY OF THE INVENTION

It is a feature of the invention to provide a vapor recoverer system for overcoming the problems of existing systems.

It is a further feature of the invention to provide a pipe suited for use with a vapor recovery system.

It is a still further feature of the invention to provide a method of installing a vapor recovery system that can be performed without the use of surveying equipment.

It is a yet still further feature of the invention to provide a vapor recovery system which prevents the formation of fluid traps.

It is a further feature of the invention to provide a vapor recovery system which eliminates the need for connecting joints.

It is still further feature of the invention to provide a vapor recovery system eliminating the need for precision installation of the system.

It is a yet still further feature of the invention to provide a vapor recovery system which is relatively inexpensive to install, so that independent gas station operators can afford to retrofit their gas stations.

It is yet another feature of the invention to provide a vapor recovery system and method of installation that is easy to carry out, thereby increasing the speed of installation and, accordingly, reducing the downtime of a gasoline station to reduce the amount of money lost by the gas station owner during installation.

It is yet another feature of the invention to provide a vapor recovery system which can be installed without the use complicated tools or sealing compounds which break down in the presence of hydrocarbons.

In summary, therefore, this invention is directed to a vapor recovery system that is accurate, inexpensive, easy to install properly, environmentally friendly, and eliminates the need for expensive tools and procedures. The vapor recovery system includes a vapor source, a fluid collection tank for collecting and storing the vapor recovered, and a vapor recovery pipe sloping vertically downwardly from the vapor source to the fluid collection tank for causing the recovered vapor to flow into the fluid collection tank, the vapor recovery pipe having an elongated cross section which extends substantially vertically. The method of constructing the vapor recovery system according to the invention without the use of surveying equipment includes digging a trench in the ground extending from the vapor source to the fluid collection tank for collecting and storing vapor, and placing a vapor recovery pipe having a elongated cross section into the trench. The method further includes positioning the vapor recovery pipe for causing the recovered vapor to flow from the vapor source to the fluid collection tank.

DETAILED DESCRIPTION OF THE INVENTION

Figure 1:
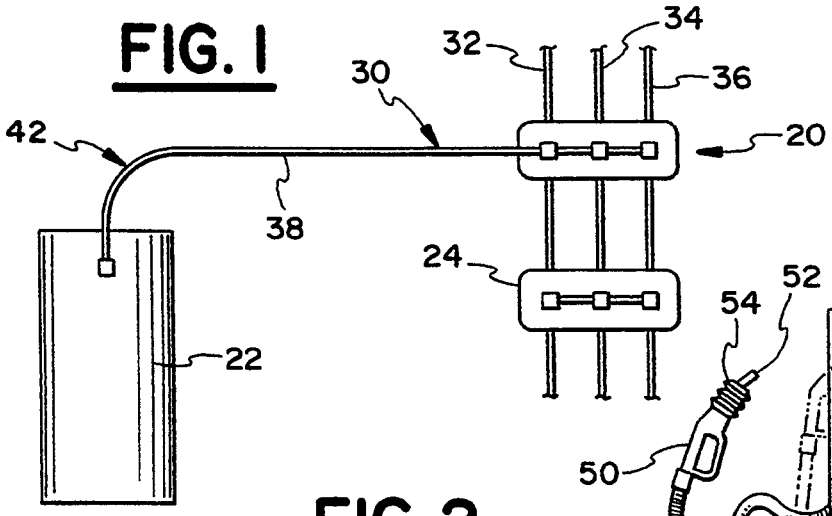
FIG. 1 is a schematic plan view of a vapor recovery system according to the invention.
Figure 2:
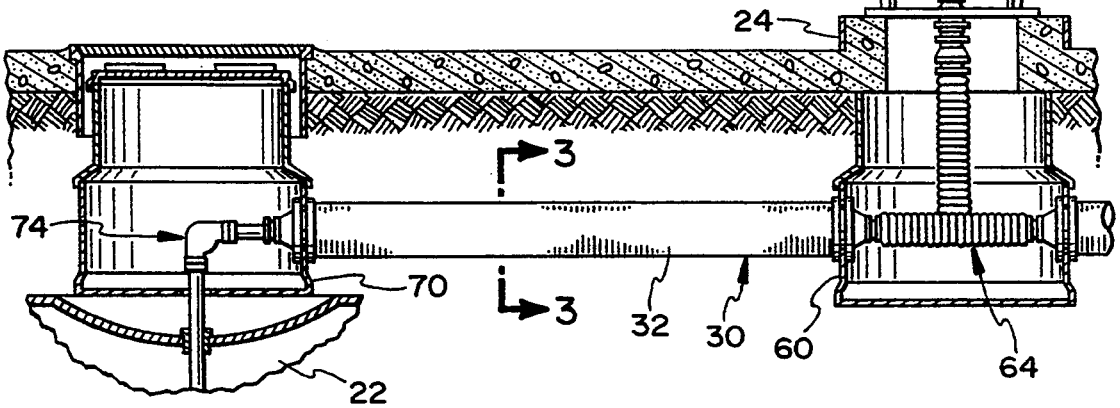
FIG. 2 is an elevational view, partially in section, of the vapor recovery system according to the invention.

Turning to FIGS. 1 and 2, a vapor recovery system 20 according to the invention is shown as typically installed underground. A fluid collection tank 22 is generally spaced from concrete islands 24 which support fluid dispensers 26 thereon.

A vapor recovery piping system 30 fluidly connects dispensers 24 with fluid collection tank 22.

Conveniently, in the case of a typical gasoline service station, which sells multiple grades of gasoline, a low octane piping 32, a medium grade piping 34, and a high octane piping 36 recover the vapor from the respective grades of gasoline and return the vapors to a common vapor return line 38 having a bend 42. Of course, separate vapor recovery return lines could be provided for each grade of gasoline, as will be readily appreciated.

A conventional product dispenser handle 50 includes a nozzle 52 and a known vapor recovery nozzle hose 54. Product dispenser handle 50 is shown "unholstered" (i.e., not in its normal resting position received by fluid dispenser 26 as shown in phantom line). Vapor recovery nozzle hose 54 is shown slightly retracted from the end of nozzle 52 for clarity. In practice, vapor recovery nozzle hose 54 is retracted when the consumer inserts nozzle 52 into the gasoline fill tube of the consumer's vehicle (not shown) so that the vapor recovery nozzle hose 54 mates with the edges of the vehicle fill tube and recovers escaping gasoline vapors which may be forced out of the consumer's gasoline tank during the filling thereof, as will be readily appreciated. A conventional vapor recovery return hose 56 fluidly connects vapor recovery nozzle hose 54 to piping system 30.

A sump riser 60 installed beneath concrete island 24 and fluid dispenser 26 maintains the proper position and attitude of fluid coupling component 64 which connect vapor recovery return hose 56 to the remainder of piping system 30.

A collection sump riser 70 is typically installed above fluid collection tank 22. One or more of the pipelines for recovering the different grades of gasoline vapor, such as common vapor return line 38 or low octane piping 32, extends from collection sump riser 70 to sump riser 60. A sequence of terminal fluid coupling components 74 fluidly connects piping system 30 with fluid collection tank 22.

Understandably, all joints and interfaces between piping system 30 with sump riser 60 and collection sump riser 70, for example, will be made fluid tight to prevent escape of the recovered vapor into the ground and/or the atmosphere.

Figure 3:
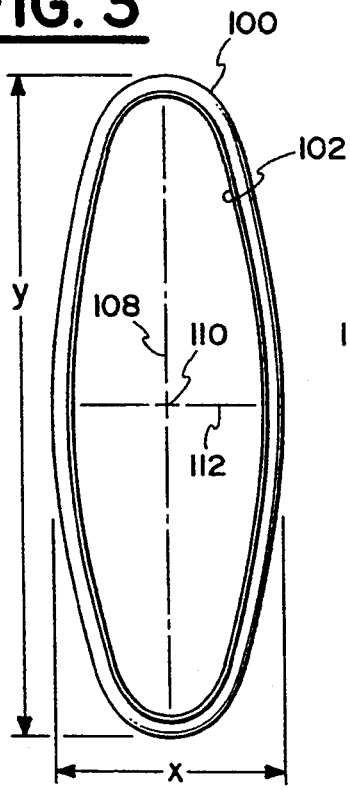
FIG. 3 is a sectional view of a pipe used with the vapor recovery system according to the invention, taken along line 3—3 of FIG. 2, on an enlarged scale.
Figure 4:
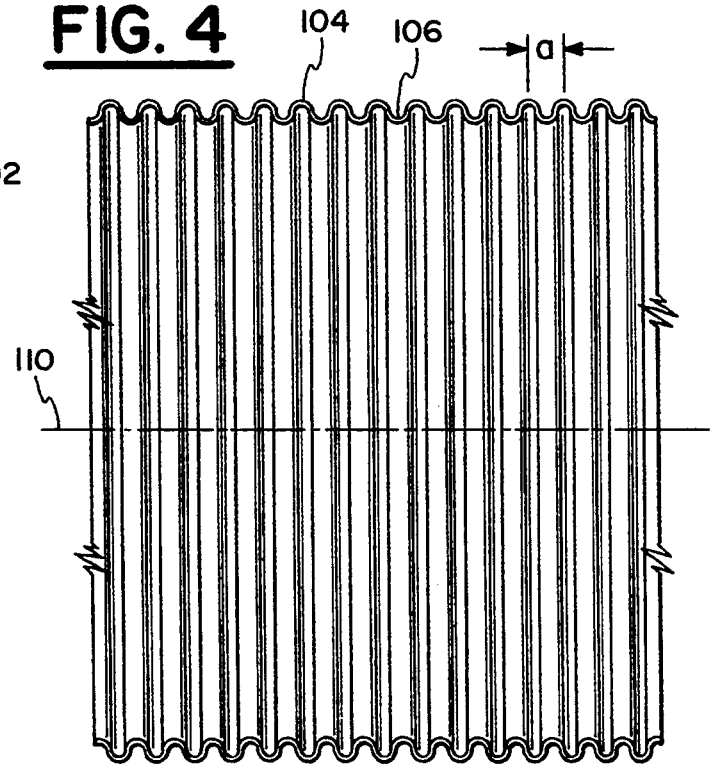
FIG. 4 is a side elevational view of the pipe of FIG. 3.

FIGS. 3 and 4 show additional details of a vapor recovery pipe 100 according to the invention. Vapor recovery pipe 100 includes a pipe wall 102, as well as corrugations including peaks 104 and valleys 106. A peak-to-peak width a is defined by the mid point of one peak to the mid point of an adjacent peak.

A width x and a height y of vapor recovery pipe 100 are selected so as to provide a desired rigidity in a first direction 108 substantially perpendicular to a longitudinal axis 110. The various dimensions of vapor recovery 100 are likewise selected so that bending of vapor recovery pipe 100 is enhanced in a second direction 112, the second direction extending substantially perpendicularly to both the longitudinal axis and to the first direction. The thickness of pipe wall 102 and the material from which vapor recovery pipe 100 is made are also chosen to give pipe 100 the desired characteristics. The appropriate characteristics of vapor recovery pipe 100 will become even more apparent after considering the description of the method of installing the vapor recovery system and its use described below.

OPERATION

To install vapor recovery system 20 according to the invention, in the case of installation underground the user digs an elongated trench in the ground between collection sump riser 70 and sump riser 60. The user then places vapor recovery pipe 100 into the trench, after substantially smoothing out a supporting bed of gravel at a desired slope, for example.

It is important that vapor recovery pipe 100 be positioned in the trench so that the direction of elongation of the elongated cross-section of pipe 100 extends substantially vertically; i.e., so that first direction 108 is substantially upright. The vertical height of one or both ends of vapor recovery pipe 100 is adjusted, as necessary, for causing vapor recovery pipe 100 to slope vertically downwardly from sump riser 60 (i.e., the vapor source) to fluid collection tank 22 (i.e., to collection sump riser 70).

Finally, the installer fluidly connects the free ends of vapor recovery pipe 100 to the respective fluid coupling components 64 and 74.

If separate piping is used for each grade of gasoline, for example, the above steps are repeated as necessary, a single trench generally being adequate for carrying more than one type of recovery piping. Preferably, a single, unbroken length of vapor recovery pipe 100 extends from collection sump riser 70 to sump riser 60, so as to reduce the number of couplings and, hence, the chance of recovered vapor being lost.

Given the resistance to bending of vapor recovery pipe 100 in the vertical direction; i.e., resistance to bending of vapor recovery pipe around an axis defined by second direction 112, irregularities in the surface of the base of the trench in which vapor recovery pipe 100 is laid do not lead to vapor blockages. That is, the rigidity of vapor recovery pipe 100 in the vertical plane causes pipe 100 to span irregularities, rather than conforming to such irregularities. In this manner, the drawbacks of conventional vapor recovery pipes in which depressions along the length of the pipe lead to liquid build-up of condensed vapor, which liquid build-up prevents the passage of vapor, are eliminated.

By the use of the elongated pipe according to the invention, a relatively straight uninterrupted fluid path is provided for recovered vapor, despite irregularities in the surface on which vapor recovery pipe 100 is laid.

Additionally, given the enhanced flexibility of vapor recovery pipe 100 in second direction 112 (i.e., enhanced flexibility and ability to bend about an axis defined by first direction 108), vapor recovery pipe 100 is able to conform to bends in the trench without the need for couplings. By eliminating the use of most couplings, the loss of recovered vapor is enhanced even more.

A vapor recovery pipe according to the invention can be made by conventional plastic forming techniques. The vapor recovery pipe is preferably made of a material which is not substantially affected by contact with hydrocarbons, such as gasoline. Such plastic materials may include polyethylene, such as high density polyethylene (HDPE) and urethane, for example. For underground installation, it is preferable that the vapor recovery pipe be made of material resistent to attack by soil microbes, and be non-biodegradable.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

I claim:

1. A system for vapor recovery without the formation of fluid blockages, comprising:

a ) a vapor source;

b) a fluid collection tank for collecting vapor;

c) a vertically downwardly sloping trench being provided;

d) a vapor recovery pipe disposed between and fluidly connecting said vapor source to said fluid collection tank;

e) said vapor recovery pipe being disposed in said trench;

f) said vapor recovery pipe sloping substantially evenly vertically downwardly from said vapor source to said fluid collection tank for causing a vapor recovered from said vapor source to flow into said fluid collection tank;

g) said vapor recovery pipe having an elongated cross section, and a direction of elongation of said cross section extending substantially vertically; and c) wherein, said vapor recovery pipe conforms to variations in the sloping trench in a horizontal plane and resists bending in the vertical plane, whereby a substantially evenly downwardly sloping fluid path within said vapor recovery pipe is obtained.

2. A system as defined in claim 1, wherein:

a) said vapor source includes a sump riser.

3. A system as defined in claim 1, wherein:

a) said fluid collection tank includes means for storing vapors and liquids.

4. A system as defined in claim 1, wherein:

a) said vapor source includes a plurality of sump risers;

b) said vapor recovery pipe includes a plurality of pipes for fluidly connecting said plurality of sump risers to said fluid collection tank.

5. A system as defined in claim 4, wherein:

a) said fluid collection tank includes means for storing a plurality of different recovered vapors; and b) whereby, when each one of said plurality of pies is connected to said plurality of sump risers, a variety of different vapors can be recovered and separately stored.

6. A method of constructing a vapor recovery system without the use of surveying equipment, said vapor recovery system recovering vapor without the formation of fluid blockages, comprising:

a) digging an elongated trench in the ground without the use of surveying equipment, the trench extending from a vapor source to a fluid collection tank for collecting and storing vapor;

b) placing a vapor recovery pipe having an elongated cross-section in the trench;

c) positioning the vapor recovery pipe in the trench for causing a direction of elongation of the elongated cross-section of the pipe to extend substantially vertically;

d) adjusting the vertical height of at least one end of the vapor recovery pipe for causing the vapor recovery pipe to slope substantially evenly vertically downwardly from the vapor source to the fluid collection tank for causing a vapor recovered from the vapor source to flow substantially evenly vertically downwardly into the fluid collection tank; and e) fluidly connecting the vapor recovery pipe to the fluid collection tank and to the vapor source.

7. A method as defined in claim 6, further comprising the steps of:

a) placing a plurality of vapor recovery pipes in the trench; and b) fluidly connecting each one of the plurality of fluid recovery pipes to the vapor source and the fluid collection tank for recovering a variety of different vapors.

* * * * *